US006301435B1

(12) United States Patent
Ito et al.

(10) Patent No.: US 6,301,435 B1
(45) Date of Patent: Oct. 9, 2001

(54) HEATING METHOD

(75) Inventors: Shinichi Ito; Katsuya Okumura, both of Yokohama (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/573,227

(22) Filed: May 19, 2000

(30) Foreign Application Priority Data

May 21, 1999 (JP) ..... 11-141695

(51) Int. Cl.[7] ..... F26B 19/00

(52) U.S. Cl. ..... 392/418; 219/390; 219/405; 118/724; 118/725; 392/416; 250/492.2

(58) Field of Search ..... 219/390, 405, 219/411; 118/724, 725, 50.1; 392/416, 418; 362/92, 244; 250/492.2, 492.22, 503.1, 504 R

(56) References Cited

U.S. PATENT DOCUMENTS 5,194,401 3/1993 Adams et al. .
5,271,077 * 12/1993 Brockman et al. ..... 385/31
5,345,534 9/1994 Najm et al. .
6,033,097 * 3/2000 Shozo et al. ..... 362/244
6,072,160 * 6/2000 Bahl ..... 219/405
6,090,210 * 7/2000 Ballance et al. ..... 118/725
6,122,439 * 9/2000 Gronet et al. ..... 392/416
6,210,484 * 4/2001 Hathaway ..... 118/724

* cited by examiner

*Primary Examiner*—Teresa Walberg
*Assistant Examiner*—Shawntina T. Fuqua
(74) *Attorney, Agent, or Firm*—Finnegan, Henderson, Farabow, Garrett & Dunner, L.L.P.

(57) ABSTRACT

A heating method for heating an object by making use of a heating apparatus comprising lamps and light transmissive columnar bodies each being positioned in front of and in the light irradiating direction of each of the lamps and having a fore-end constituting a light-receiving face for taking up an irradiated light from the lamp and a rear-end constituting a light-irradiating face for irradiating light; the object being disposed to face the light-irradiating faces of the light transmissive columnar bodies and heated by the irradiation of light transmitted via the light transmissive columnar bodies from the lamps. A distance between the light-irradiating faces of the light transmissive columnar bodies and the object is set to around 0.3L or not less than 0.8L (herein, L is a width of the light-irradiating face).

20 Claims, 7 Drawing Sheets

HEATING METHOD

CROSS-REFERENCE TO RELATED APPLICATIONS

This application is based upon and claims the benefit of priority from the prior Japanese Patent Application No. 11-141695, filed May 21, 1999, filed, the entire contents of which are incorporated herein by reference.

BACKGROUND OF THE INVENTION

This invention relates to a heating method, and in particular to a heating method wherein a light transmissive columnar body is interposed between a lamp and an object (a body to be treated), so that the object is irradiated with light from the lamp through this light transmissive columnar body.

In a heating method using a lamp as a heating source, since the light to be emitted from the lamp is dispersible and the uniformity of the lamp is caused to be reflected in the light, it has been very difficult to perform the heating with excellent uniformity. Further, since the heating source is positioned in the vicinity of the object, it is difficult to effectively cool the object after heating. Additionally, since a reaction atmosphere gives an influence to the external wall of lamp when the heating is performed under a reaction atmosphere, the lamp itself may be badly affected in the heating.

With a view to overcome these problems, the present inventors have developed a method wherein a light transmissive columnar body such as a quartz rod is interposed between a lamp and an object, thereby enlarging the distance between the heating source and the object and at the same time, allowing the light from the lamp to be taken up by the light transmissive columnar body so as to allow the light introduced into the light transmissive columnar body to be reflected several times by the wall surface of the light transmissive columnar body before the light is emitted out of the light transmissive columnar body.

Since light of excellent uniformity is allowed to emit from the light transmissive columnar body in this method, it is possible, through the irradiation of this light onto an object, to perform a uniform heating of the object. Moreover, since the heating source can be placed far away from the object, the maintenance of the apparatus can be facilitated.

However, there are still problems even in this method as explained below. Namely, although the light emitted from the light transmissive columnar body is excellent in uniformity as compared with the light emitted from a lamp, a reduction of optical intensity is caused to occur at the corner portions of the light transmissive columnar body, thereby making it difficult to realize a sufficient uniformity of light depending on the distance between the object and the light irradiating face of the light transmissive columnar body. Further, in the case of heating using a lamp as a heat source, when the input power to the lamp is altered through the changes of voltage, the color temperature of the lamp is also caused to change, thereby changing the radiant heat and hence, making it difficult to suitably control the heating temperature.

As explained above, even with the heating method wherein a light transmissive columnar body is interposed between a heating lamp and an object, it is still difficult to realize a sufficient uniformity of heating depending on the distance between the object and the light irradiating face of the light transmissive columnar body, or to suitably control the heating temperature.

In the meantime, on the occasion of forming a liquid film over a treating substrate in the process of developing a resist film on the surface of treating substrate such as a semiconductor substrate or in the process of performing a wet etching of a treating substrate, a heat transfer is caused to occur between the treating substrate and the liquid film due to the heat of vaporization on the surface of the liquid film, thus giving rise to the phenomenon of lowering the temperature of the treating substrate.

The generation of this phenomenon is more prominent especially at the peripheral region of the treating substrate. Therefore, due to this phenomenon, the treatment of the treating substrate tends to be retarded at the peripheral region thereof, thus deteriorating the uniformity of working.

Further, due to the endothermic or exothermic phenomenon to be generated on the occasion of treatment such as the developing step or wet etching step in a so-called resist process, a temperature distribution is caused to generate on the surface of a treating substrate, thus deteriorating the uniformity of working.

Japanese Patent Examined Publication No. 6-93440 discloses a apparatus wherein a vertical wall of a susceptor (light guide) surrounding a lamp is used as a light reflecting surface, and a light energy reflected by the light reflecting surface is supplied to the object. In this apparatus, however, a heat generated in the light guide is supplied to the object, and thus deteriorating an uniformity of the temperature of the object. Further, since the guide and the lamp are integrally formed, it is necessary to arrange means for dissipate a heat. For that reason, it is necessary to form a space in the guide.

The present invention provides a method in which a heat accumulated in the susceptor (light guide) is not transferred to the object, a second light guide consisting of a light transmissive columnar body is arranged beyond and contiguous with the susceptor (light guide) to unlimitedly decrease a light intensity distribution on the light-irradiating surface of the second light guide and to unlimitedly decrease a heat amount generated in the second light guide. According to the present invention, it is possible to supply a light energy to the object with high uniformity and high efficiency.

BRIEF SUMMARY OF THE INVENTION

An object of the present invention is to provide a heating method which enables to minimize the influence to be brought about by the reduction of optical intensity at the corner portions of the light transmissive columnar body, and to sufficiently enhance the uniformity of heating to an object.

Another object of the present invention is to provide a heating method which enables to suitably control the temperature of a treating substrate in a heating process wherein a light transmissive columnar body is interposed between a heating lamp and an object.

A further object of the present invention is to provide a heating method which enables to adjust any unbalance of heating on the occasion of treating a treating substrate.

Namely, according to this invention, there is provided a heating method for heating an object by making use of a heating apparatus comprising a plurality of lamps, and a plurality of light transmissive columnar bodies each being positioned in front of and in the light irradiating direction of each of the lamps and having a fore-end constituting a light-receiving face for taking up an irradiated light from the lamp and a rear-end constituting a light-irradiating face for irradiating light; the object being designed to be disposed to face the light-irradiating faces of the light transmissive columnar bodies and designed to be heated by the irradiation of light transmitted via the light transmissive columnar bodies from the lamps;

wherein a distance between the light-irradiating faces of the light transmissive columnar bodies and the object is set to around 0.3 L or not less than 0.8 L (herein, L is a width of the light-irradiating face of the light transmissive columnar body).

There is also provided a heating method for heating an object by making use of a heating apparatus comprising a plurality of lamps, and a plurality of light transmissive columnar bodies each being positioned in front of and in the light irradiating direction of each of the lamps and having a fore-end constituting a light-receiving face for taking up an irradiated light from the lamp and a rear-end constituting a light-irradiating face for irradiating light; the object being designed to be disposed to face the light-irradiating faces of the light transmissive columnar bodies and designed to be heated by the irradiation of light transmitted via the light transmissive columnar bodies from the lamps;

wherein a control of input to the lamp is performed based on a change of color temperature to be brought about by the input and on a heating characteristic of the object at a color temperature before the input and at a color temperature after the input.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
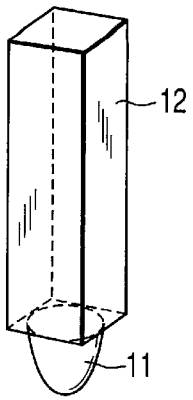
FIG. 1 is a perspective view showing a heating unit employed in Example 1.

The heating method according to a first aspect of this invention is featured in that it makes use of a heating apparatus comprising a plurality of lamps, and a plurality of light transmissive columnar bodies, wherein a distance between the light-irradiating faces of the light transmissive columnar bodies and the object is set to around 0.3 L or not less than 0.8 L (herein, L is a width of the light-irradiating face of the light transmissive columnar body).

The expression of "around 0.3 L" as set forth in this specification means that it is not restricted to a value of 0.3 L, rather it includes a narrow range of values around 0.3 L such as 0.27 L to 0.33 L.

Followings are preferable embodiments of the first aspect of this invention.

(1) The distance between the light-irradiating faces of the light transmissive columnar bodies and the object is set to 1 L or more.

(2) The light to be irradiated from the lamp is selected from the group consisting of visible rays, infrared rays, ultraviolet rays and these laser beam.

(3) The light transmissive columnar body is formed of a prism or a circular rod.

(4) The object is selected from the group consisting of a semi-finished substrate during the manufacturing process of a semiconductor device, a semi-finished substrate during the manufacturing process of a liquid crystal element, and a semi-finished substrate during the manufacturing process of an exposure mask.

(5) The object is placed to face and fall within a region of the light transmissive columnar bodies, which is disposed inner than an outermost circumference of entire region of the light transmissive columnar bodies by a distance corresponding to the magnitude of divergence L of light.

(6) The object is placed coaxial with or slightly off-centered from the center of the heating apparatus.

(7) When the distance between the light-irradiating faces of the light transmissive columnar bodies and the object is set to around 0.3 L, the region for heating the object is confined within a region to be defined by a circular line to be formed by successively connecting the centers of the light-irradiating faces of the light transmissive columnar bodies positioned at the outermost circumferential region among a plurality of the light transmissive columnar bodies.

(8) When the distance between the light-irradiating faces of the light transmissive columnar bodies and the object is set to 0.8 L or more, the region for heating the object is confined within a region to be defined by a circular line which is disposed inner than the outermost circumferential edges of the outermost light transmissive columnar bodies by a distance corresponding to the magnitude of divergence L of light among a plurality of the light transmissive columnar bodies.

(9) The center of the light-emitting face of the lamp is substantially aligned with the center of light-irradiating faces of the light transmissive columnar bodies.

(10) The center of the light-emitting face of the lamp is off-centered from the center of light-irradiating faces of the light transmissive columnar bodies.

(11) A light transmissive plate is interposed between the light transmissive columnar bodies and the object.

(12) The magnitude of light emission of the lamps disposed at a position corresponding to the outer periphery of the object among said plurality of lamps is made larger than that of the lamps other than the first-mentioned lamps.

(13) The method further comprises a step of forming a liquid film on a surface of the object which faces the light-irradiating faces of the light transmissive columnar bodies, and, among said plurality of lamps, the lamps disposed at a place which corresponds to a lower temperature region of the object in a temperature distribution of the object generated by said liquid film or by a reaction of said liquid film with the object are operated to increase the magnitude of light emission so as to offset the temperature distribution of the object.

(14) The object is a substrate (e.g. a silicon substrate) having a film (e.g. an oxide film) on one of its main surfaces, and the irradiation of light is performed against the other main surface of the substrate which is opposite to the main surface where said film is formed, wherein the maximum wavelength of light emission of the lamps is selected such that it is not absorbed by the substrate but it is absorbed by the film.

(15) The object is a substrate (e.g. a silicon substrate) having a film (e.g. an oxide film) on one of its main surfaces, and the irradiation of light is performed against the other main surface of the substrate which is opposite to the main surface where said film is formed, wherein the maximum wavelength of light emission of the lamps falls within the absorption band of silicon.

(16) The object is a substrate (e.g. a silicon substrate) having a film (e.g. an oxide film) on one of its main surfaces, and the irradiation of light is performed against the main surface of the substrate where said film is formed, wherein the color temperature of the lamps is selected such that the light emission intensity of the wavelength of absorption band of the substrate or the film (e.g. vibration absorption band of OH group which enables to generate a double wavelength) becomes maximum.

The heating method according to a second aspect of this invention is featured in that it makes use of a heating apparatus comprising a plurality of lamps, and a plurality of light transmissive columnar bodies, wherein a control of input to said lamp is performed based on a change of color temperature to be brought about by said input and on a heating characteristic of said object at a color temperature before said input and at a color temperature after said input.

Just like the aforementioned first aspect of this invention, it is preferable in this second aspect of this invention also that a distance between the light-irradiating faces of the light transmissive columnar bodies and the object is set to around 0.3 L or not less than 0.8 L (herein, L is a width of the light-irradiating face of the light transmissive columnar body).

According to the first aspect of this invention, when the distance between the light-irradiating faces of the light transmissive columnar bodies and the object is set to around 0.3 L or not less than 0.8 L (herein, L is a width of the light-irradiating face of the light transmissive columnar body), the influence of a deterioration of optical intensity at the corner portion of the columnar body can be minimized, thus making it possible to sufficiently enhance the uniformity in heating the object.

The columnar body takes up the light from the lamp through one end face thereof, and then, allows the light thus taken up to be emitted from the opposite end face thereof after allowing the light to be reflected several times by the inner wall surface thereof. As a result, the light being irradiated is excellent in uniformity as compared with the light to be irradiated directly from the lamp. Therefore, by making use of the light which is emitted from the columnar body in the irradiation of the object, a uniform heating of the object can be realized. Additionally, by optimizing the distance between the light-irradiating faces of the light transmissive columnar bodies and the object as explained below according to the first aspect of this invention, the uniformity of heating can be further enhanced.

According to the second aspect of this invention, by performing the control of input to the lamp based on a change of color temperature to be brought about by the input and on a heating characteristic of the object at a color temperature before said input and at a color temperature after said input, it becomes possible to perform an optimum temperature control of the object.

Depending on the kind of the object, part of the irradiated light from a heating device may be transmitted through the object. Therefore, it is required to perform the correction on the control of lamps, depending on the kind of the object. Especially, when the emissivity contributing to the heating of the object is caused to change by a color temperature, the correction coefficient would be varied depending on whether the input to lamp should be increased or decreased. Therefore, according to the second aspect of this invention, this correction coefficient, etc. is determined in advance, and then, the controlling of the input to lamp performed in accordance with the color temperature that is desired, thereby making it possible to optimize the temperature control.

Next, specific embodiments of this invention will be explained in detail with reference to FIGS.

EXAMPLE 1

FIG. 1 shows a heating unit employed in a first example of this invention. This heating unit was constituted by an infrared lamp 11, and a rectangular parallelepiped light-transmissive columnar body 12 disposed on the infrared ray-irradiating side of the lamp 11. A quartz rod was used as the light-transmissive columnar body 12. This quartz rod 12 was constructed to have a 40 mm×40 mm square infrared ray-receiving face and a 40 mm×40 mm square infrared ray-emitting face, the length thereof being 200 mm and the surface thereof being polished to have an optical surface. The inner diameter of the mirror of the lamp 11 was set to 39 mm which was almost the same as the length of the side of the light-receiving face of quartz rod 12.

Figure 2:
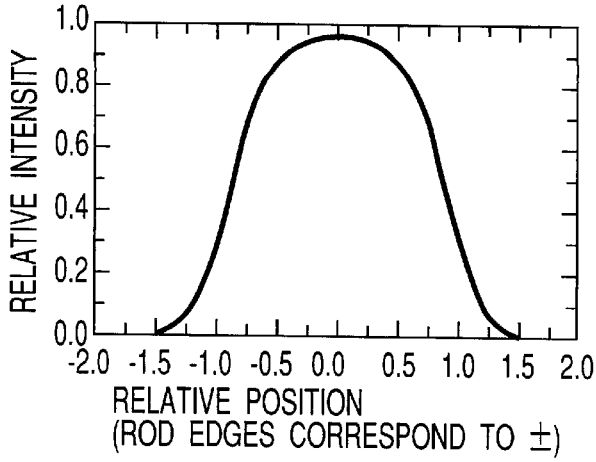
FIG. 2 is a graph showing an infrared radiation intensity at a place spaced apart by 8 mm from the irradiating face of a quartz rod.
Figure 3:
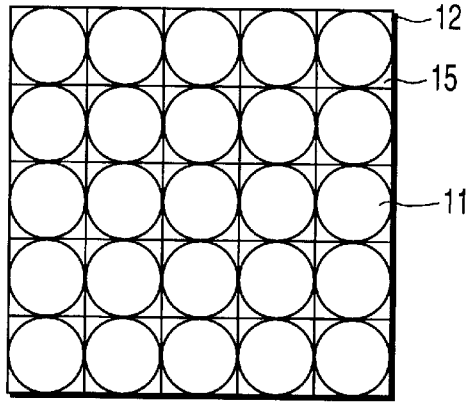
FIG. 3 is a plan view showing an example wherein the heating units shown in FIG. 1 are arranged in a lattice pattern of 5×5.

The irradiation intensity of infrared ray (a component of light passing through the center of the infrared ray-emitting face and orthogonally intersecting the side wall) as measured at a position spaced apart from the infrared ray-emitting face after allowing the infrared ray irradiated from the lamp 11 to pass through the quartz rod 12 was as shown in FIG. 2. The abscissa of graph in FIG. 2 is normalized by "width of ray-emitting face/2" (±1.0 of abscissa correspond to both edges of the quartz rod). Further, the irradiation intensity was normalized by the maximum intensity. The heating unit shown in FIG. 1 was arranged in a lattice pattern of 5×5 as shown in FIG. 3, thereby constructing a heating apparatus. The reference numeral 15 in FIG. 3 denotes a lamp housing.

Figure 4:
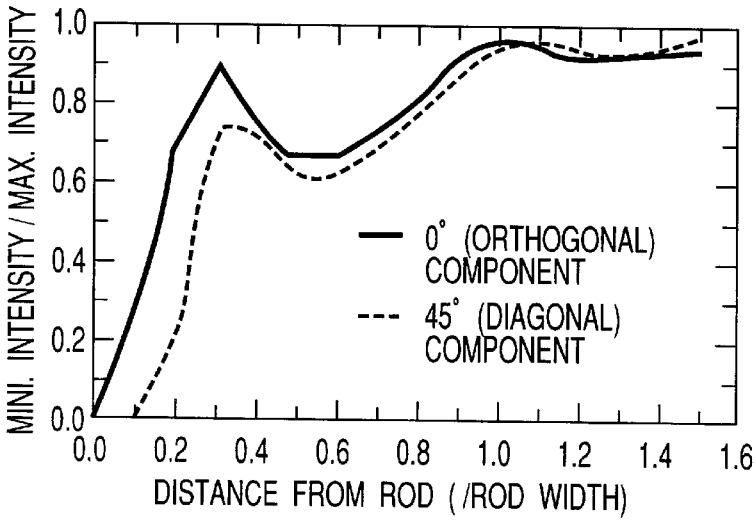
FIG. 4 is a graph showing the relationship between the distance from the irradiating face of the quartz rod (light transmissive columnar body) to the object and the minimum optical intensity/the maximum optical intensity of a region over the object.

Then, by making use of the heating apparatus shown in FIG. 3, the distance between the object and the infrared ray irradiating face of the quartz rod as well as the minimum optical intensity/the maximum optical intensity of a region of surface of the object facing the infrared ray irradiating face of the quartz rod were measured to determine the relationship between them, the result being shown in FIG. 4. The solid line in FIG. 4 represents the distribution of intensity of the light passing through the center of the infrared ray-emitting face and orthogonally intersecting the side wall, while the broken line represents the distribution of optical intensity in the direction of diagonal line. The width of the ray-irradiating face of the quartz rod (the rod width, the length of one side) was defined as L.

The results shown in FIG. 4 illustrate the following facts. Namely, in every cases, it showed a peak value at a distance of 0.3 L. When the distance was set to 0.3 L, the light irradiated from four quartz rods contacting with each other is overlapped with each other in a balanced manner at the region facing to each other through the corners of the quartz rods, so that the difference between the maximum intensity and minimum intensity was minimized (the ratio thereof being close to 1). However, when this distance was further enlarged, the difference in intensity became enlarged. Namely, when this distance was set to the range of 0.4 L to 0.8 L, the balance of overlapping was deteriorated, thus increasing the difference in intensity. However, when this distance was set to 0.8 L or more, the uniformity of optical intensity was regained. In particular, when this distance was set to 1 L or more, a more excellent result than that obtained from the distance of 0.3 L was obtained.

The dispersing angle of light as it is emitted into air atmosphere from the quartz rod was 45° at maximum. Accordingly, the distance between the object and the infrared ray irradiating face of the quartz rod was found identical with the magnitude of divergence of light, so that when the object was placed away from the irradiating face of the quartz rod by a distance of 1 L, the light would be dispersed by the magnitude of 1 L. Therefore, the condition for achieving the uniformity of irradiation can be defined by the magnitude of light divergence on the surface of the object. Namely, the position of the object can be preferably set in such a manner that the light divergence in one radial direction thereof becomes around 0.3 L or not less than 0.8 L as measured on the surface of the object and on the basis of the distribution of light immediately after it is emitted from the light irradiating face of the quartz rod.

This definition can be also applied to a case wherein a quartz plate is interposed between the object and the infrared ray irradiating face of the quartz rod. Namely, even if the length of optical path is altered by the interposition of the quartz plate, it is possible to ensure an excellent uniformity of heating by setting the distance between the object and the quartz plate in such a manner that the divergence of light emitted from the quartz plate becomes around 0.3 L or not less than 0.8 L as measured on the surface of the object.

In this case however, the following relationship should be adopted in place of the aforementioned distance between the object and the light irradiating face of the quartz rod. Namely, in the case where the quartz plate is contacted with the light irradiating face of the quartz rod, the thickness ($L_1$) of quartz plate and the distance ($L_2$) between the object and the quartz plate meet the relationship of: $(L_1/n)+L_2$=around 0.3 L or not less than 0.8 L (wherein n is a refractive index of quartz plate).

By the way, if a quartz plate is to be interposed between the object and the infrared ray irradiating face of the quartz rod, the concentration of OH group in the material of quartz plate should preferably be confined to several ppb. Because, if the concentration of OH group is higher than this limitation, infrared rays may be absorbed by the OH group, thereby deteriorating the heat transmission efficiency.

Figure 5A:
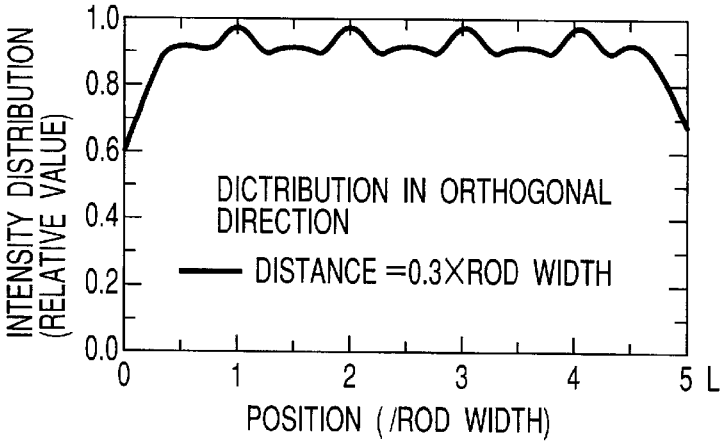
FIGS. 5A and 5B respectively shows a graph showing the distribution of optical intensity when an object is spaced apart by a distance of 0.3 L from the irradiation face of the quartz rod (light transmissive columnar body)
Figure 5B:
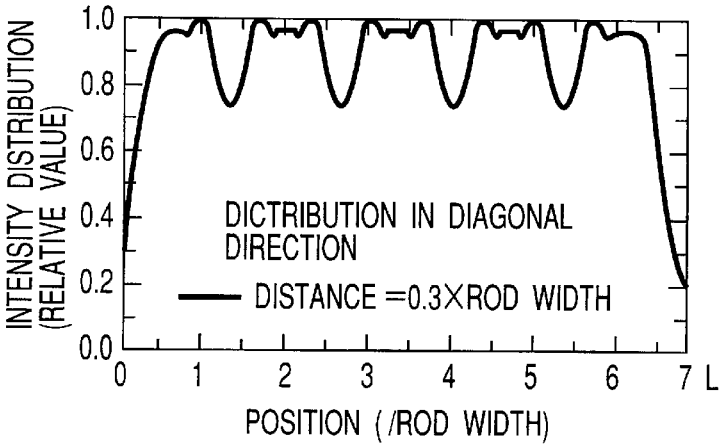
Figure 6:
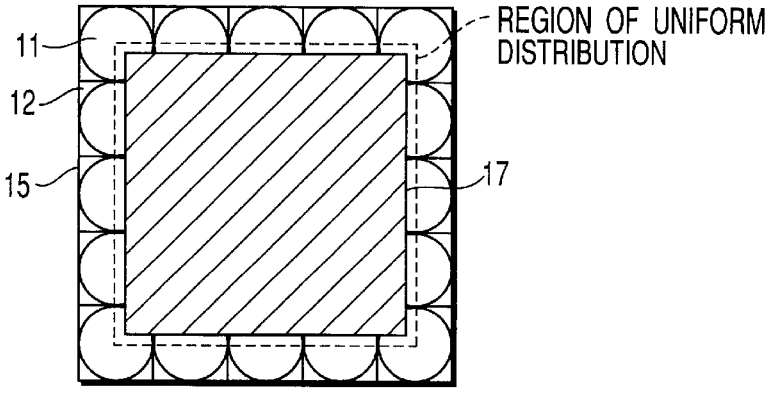
FIG. 6 is a plan view a preferable example of arranging the treating bodies to a heating apparatus.

Meanwhile, when the distribution of optical intensity was measured by setting the distance between the object and the light irradiating face of the quartz rod to around 0.3 L, the results as shown in FIGS. 5A and 5B could be obtained. FIG. 5A shows the distribution in the direction of orthogonal line, while FIG. 5B shows the distribution in the direction of diagonal line. In any of these FIGS., the abscissa is normalized by a rod width L. It will be seen from FIGS. 5A and 5B that it is possible to ensure the uniformity of optical intensity at the region inner than the centers of the units which are located at the outermost peripheral zone. In this case, as shown in FIG. 6, the object 17 should preferably be disposed at a region inner than the centers (indicated by a broken line in FIG. 6) of the units which are located at the outermost peripheral zone.

Figure 7A:
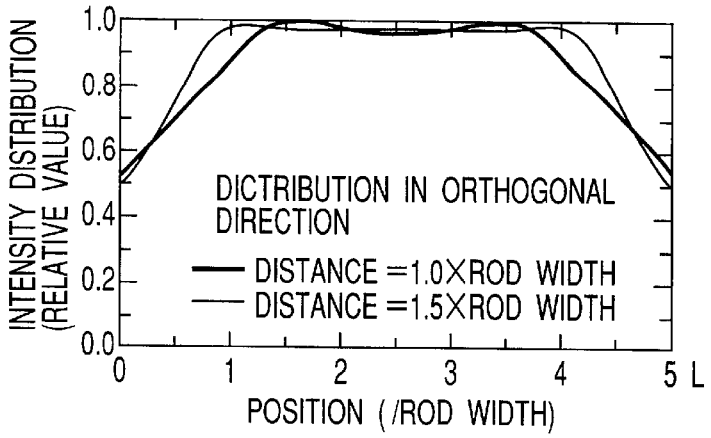
FIGS. 7A and 7B respectively shows a graph showing the distribution of optical intensity when an object is spaced apart by a distance of 1 L from the irradiation face of the quartz rod (light transmissive columnar body)
Figure 7B:
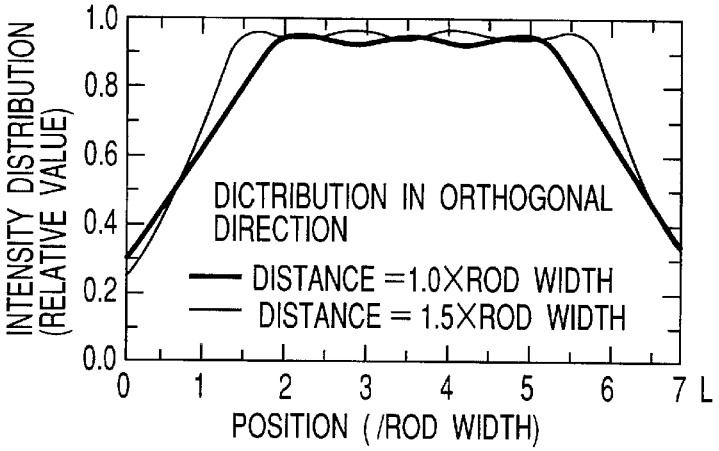
Figure 8A:
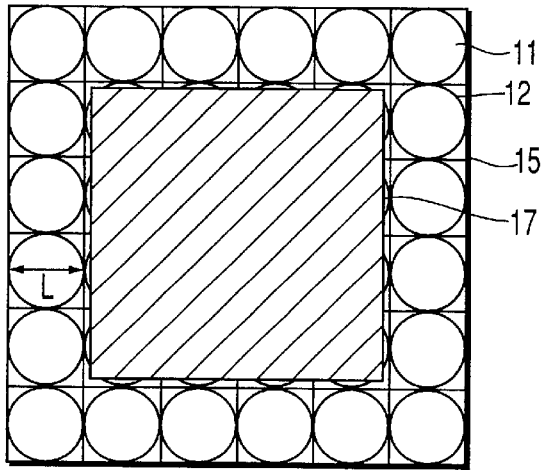
FIGS. 8A and 8B a plan view and a side view, respectively, illustrating a preferable example of arranging the treating bodies to a heating apparatus.

When the distance between the object and the light irradiating face of the quartz rod is set to 0.8 L or more, in particular 1 L or more, the region which enables to ensure a uniform heating is a region at least 1 L inner than the outer fringe portions of the units which are located at the outermost peripheral zone as shown in FIGS. 7A and 7B. In this case, as shown in FIG. 8A, the object 17 should preferably be disposed at a region at least 1 L inner than the outer fringe of the heating device (indicated by a broken line in FIG. 8A).

Although the same magnitude of input was applied to all of the lamps in this example, it may be preferable, in view of the heat release at the circumferential portion of the object, to apply a proportionally higher input to the units disposed at the outermost region as compared with that to be applied to the units disposed at an inner region, thereby compensating the aforementioned heat release. Even in this case, the aforementioned relationship between the divergence of light and the assurance of uniform heating would be applicable. Further, when the aforementioned distance is around 0.3, the object may be rotated during the heating step. When the object is treated in this manner, the effects as shown in FIGS. 5A and 5B can be obtained, and at the same time, the heating uniformity can be further improved as compared with the case where the object is fixed in place.

According to this example, in the heating of the object 17 by making use of a heating device wherein units each consisting of the lamp 11 and the quartz rod 12 are arrayed in a lattice pattern, the distance between the light-irradiating faces of the quartz rods 12 and the object 17 is set to around 0.3 L or not less than 0.8 L (herein, L is a width of the quartz rod 12), thereby making it possible to minimize the influence of a deterioration of optical intensity at the corner portion of the columnar body and hence, to enhance the uniformity in heating the object 17.

EXAMPLE 2

In this example, the heating device shown in FIG. 3 was utilized for the baking step following the EB-depicting step in the process of manufacturing an exposure mask (6.35 mm in thickness) by making use of a chemically amplified resist. The construction of heating was as shown in the top plan view of FIG. 8A and in the side view of FIG. 8B. The quartz rods 12 were disposed over the infrared lamps 11, and an exposure mask was disposed over the quartz rods 12. This exposure mask was formed of a quartz substrate 21 on which a Cr film 22 was deposited. This Cr film 22 was heated through the substrate 21.

When the distance between the quartz rods 12 and the Cr film 22 (object) was set to 2 mm, the temperature distribution of the surface of the exposure mask was as bad as 110±3° C. Further, the line width obtained after the development thereof was as bad as 600±120 nm. The length of optical path in this setting corresponds to 6.4 mm or 0.15 L since the refractive index of the quartz substrate 21 was 1.45. Since the magnitude of divergence of light was 6.25 mm (0.15 L), the uniformity of heating was also considered as being unsatisfactory.

Therefore, according to the relationship shown in FIG. 4 and by taking the thickness of quartz substrate 21 into consideration, the distance between the irradiating face of quartz rods 12 and the quartz substrate 21 was adjusted to 7.6 mm, thereby making the divergence of light into 12 mm (an effective optical path is 0.3 L) at the Cr film 22 constituting the object of the exposure mask. Additionally, the substrate 21 was rotated during the heating step. As a result, it was possible to obtain a uniform temperature distribution, thereby enabling to treat the patterned region with a temperature distribution of 110±0.5° C. Furthermore, the line width obtained after the development thereof was as good as 600±13 nm.

On the other hand, by taking the thickness of quartz substrate 21 into consideration, the distance between the irradiating face of quartz rods 12 and the quartz substrate 21 was adjusted to 35.7 mm, thereby making the divergence of light into 40 mm (1 L) at the surface of the Cr film 22 or the exposure mask. As a result, it was possible, without necessitating the rotation of the substrate 21 during heating step, to obtain a uniform temperature distribution, thereby enabling to treat the patterned region with a temperature distribution of 110±0.4° C. Furthermore, the line width obtained after the development thereof was as good as 600±10 nm.

As for the heating body for an exposure mask, it is not confined to Cr that has been employed in this example. Namely, various kinds of light-shielding material, extinction coefficient of which is not zero, such as MoSi, and various kinds of translucent material such as MoSiO, MoSiON, CrF, CrOF, etc. can be employed.

Further, the input value to be applied to the lamp 11 may be suitably controlled so as to make the temperature of surface of the object become uniform. With respect to this controlling, in addition to the conventional PID control, a correcting mechanism for correcting a difference in radiant heat that may be brought about by the changes of color temperature on the occasion of changing input value should preferably be incorporated into the heating device.

EXAMPLE 3

In this example, the heating device shown in FIG. 3 was utilized for heating a Si wafer. Since the size of the object (Si wafer) was 200 mm in diameter, the width of the quartz rod was changed to 50 mm, and a lamp having a diameter of 49 mm was employed.

Figure 9:
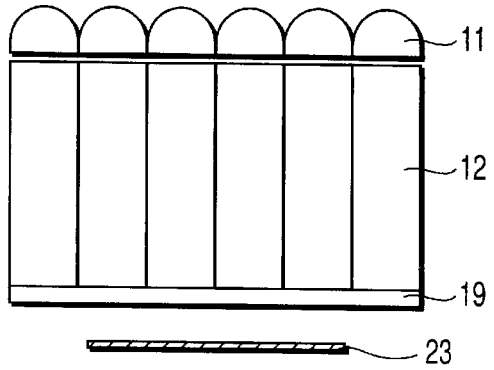
FIG. 9 is a side view illustrating the relationship in position between the heating device and the object in Example 3.

Since the substrate is heated from the front surface in this example, the quartz rods 12 and the infrared lamps 11 were disposed over the infrared lamps 11, and an exposure mask is disposed over a Si substrate 23 constituting the object as shown in FIG. 9. For the purpose of sustaining the quartz rods 12, a quartz plate 19 having a thickness of 15 mm was disposed below the underside of the quartz rods 12.

The distance between the bottom of quartz rods 12 and the surface of Si substrate 23 was set to 40 mm so that the divergence of the light from one lamp exceeded 50 mm (1 L) at the surface of the Si substrate 23 (the length of optical path in the quartz rod (15/1.45)+the length of optical path of in air atmosphere (40>50 (L)).

Since the infrared rays to be irradiated from the lamps 11 is capable of partially permeating through the Si substrate 23 (1.2 $\mu$m or more), the correction of the control (input) of the lamp 11 is required.

Figure 10A:
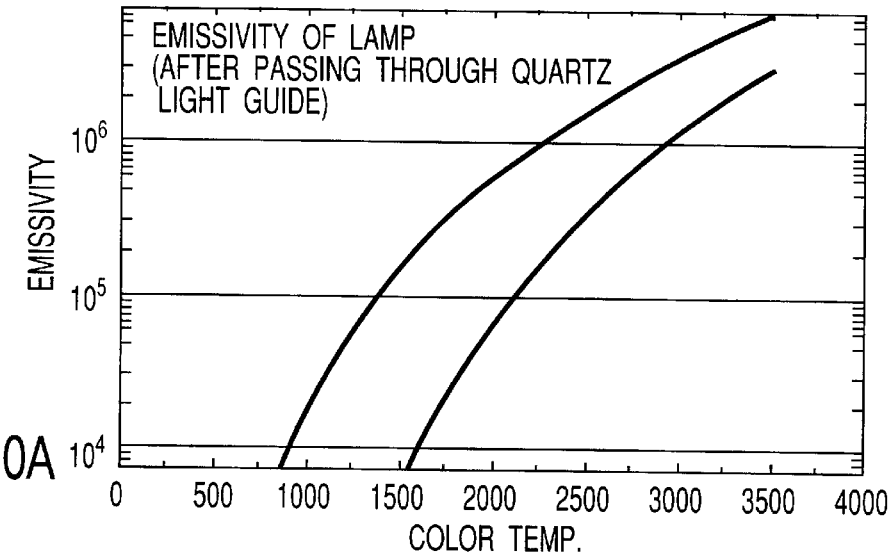
FIGS. 10A and 10B show the graphs illustrating the relationship between the color temperature and the emissivity, and the relationship between the color temperature and the correction coefficient, respectively.

FIG. 10A illustrates the relationship between the emissivity of infrared lamp relative to the color temperature and the emissivity contributing to the heating of Si wafer. It will be seen from FIG. 10A that as the color temperature was lowered, the emissivity contributing to the heating of Si wafer was also minimized. Namely, when the color temperature was different, even if the input to lamp is altered in the same degree, the variation of heating to the Si wafer would become different from each other. Therefore, if the input to lamp is to be altered, the input is required to be corrected depending on the color temperature.

Figure 10B:
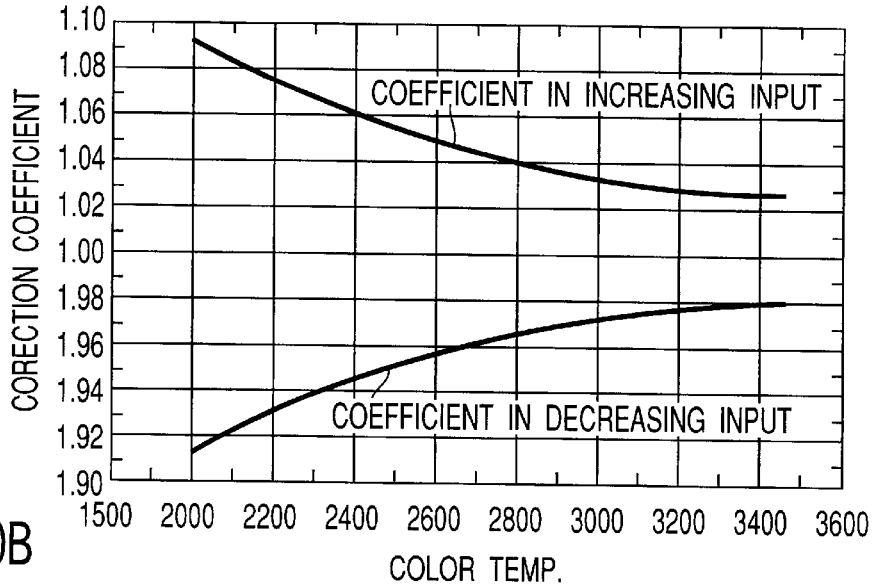

FIG. 10B show the correction coefficient for the input that has been prepared based on FIG. 10A. In the color temperature region of 2,800K which is effective for the heating of the Si substrate, a correction of several % is required to be made against the value of input. For example, when an increase in input of 10 W is required to be performed against the lamp irradiating a color temperature of 2,800K, an additional input of 10.4 W (10 W×1.04) is required to be executed as the changes in color temperature to be brought about by the input and the permeability of Si substrate are taken into consideration. On the other hand, when a decrease in output of 20 W is required to be performed against the lamp, the output is required to be lowered by 19.2 W (20 W×0.96).

As explained above, the PID control is additionally provided with a correction concerning the emissivity of lamp and the changes in absorbency of object which are to be brought about by the changes in color temperature in the input of power to the lamp. As a result, it can be sufficiently coped with the changes in color temperature to be brought about during the controlling, and hence, a controlling of high precision can be realized.

Based on the controlling incorporated with the aforementioned corrections, the heat treatment of a reflection preventive film formed on the surface of Si substrate was tried. As for the reflection preventive film, a film capable of generating a reflection preventive property as it is reacted in the heat treatment was employed. The Si substrate coated with such a reflection preventive film was quickly heated up to 200° C., and after being kept at this temperature, was quickly cooled down from 200° C. As a result, it was found after this heat treatment that in contrast to the controlling method where the correction concerning the emissivity of lamp and the changes in absorbency of object brought about by the changes in color temperature was not taken into account, it was possible to greatly minimize (uniformalization) the in-plane distribution of optical constants.

EXAMPLE 4

Figure 11:
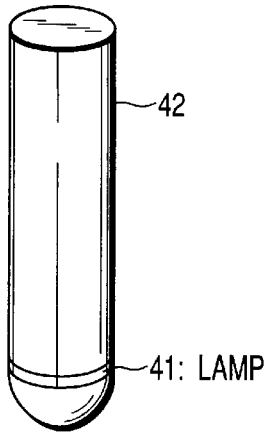
FIG. 11 is a perspective view showing the construction of the heating unit employed in Example 4.

FIG. 11 shows a heating unit employed in a fourth example of this invention. This heating unit was constituted by a lamp 41, and a prismatic (rectangular parallelepiped) quartz rod 42 disposed on the light-irradiating side of the lamp 41. This quartz rod 42 was constructed to have a 40 mm diameter infrared ray-receiving face and a 40 mm diameter infrared ray-emitting face, the length thereof being 300 mm and the surface thereof being polished to have an optical surface. The inner diameter of the mirror of the lamp 41 was set to 39 mm which was almost the same as the width of the light-receiving face of quartz rod 42.

Figure 12A:
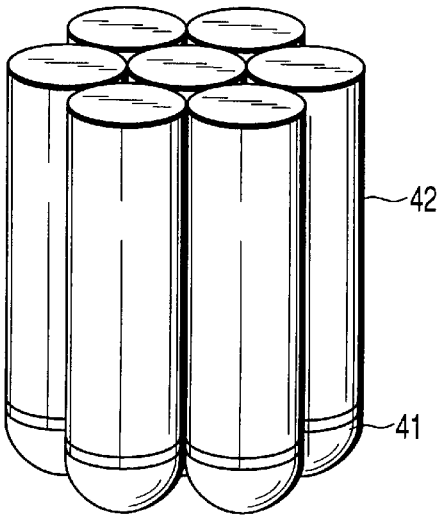
FIGS. 12A and 12B respectively shows a perspective view showing an example of the arrangement of the heating units in Example 4.
Figure 12B:
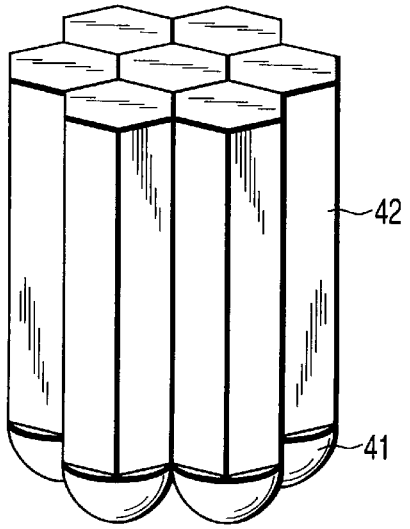

FIGS. 12A and 12B show examples of the construction of heating unit wherein the units are arranged in a close-packed structure, i.e. each axis of the lamps 41 and each axis of the quartz rods 42 are respectively positioned at each apical position and the central position of a regular hexagonal configuration. In any of FIGS. 12A and 12B, the device is constituted by seven pieces of heating unit as shown in FIG. 11, wherein a columnar quartz rod is employed in FIG. 12A, while a hexagonal prismatic quartz rod (both light-receiving face and light-emitting face are hexagonal) is employed in FIG. 12B.

Figure 13A:
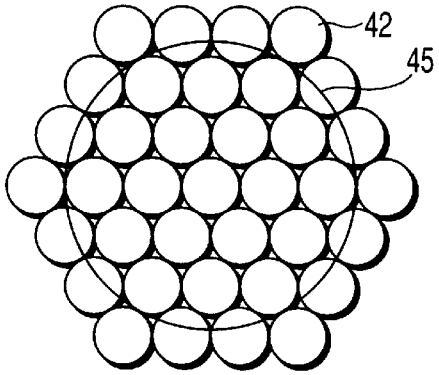
FIGS. 13A and 13B respectively shows a plan view showing an example of the arrangement of the heating units in Example 4.
Figure 13B:
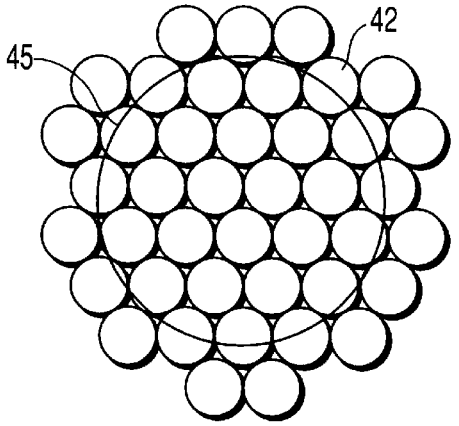
Figure 14A:
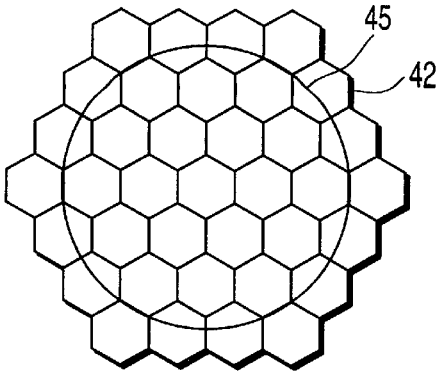
FIGS. 14A and 14B respectively shows a plan view showing an example of the arrangement of the heating units in Example 4.
Figure 14B:
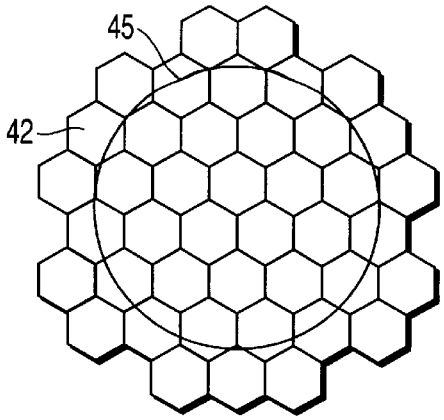

Examples of the arrangement of these heating units which can be employed in heating through irradiation of a semiconductor substrate having a diameter of 200 mm for instance are shown in FIGS. 13A and 13B (columnar) and FIGS. 14A and 14B (hexagonal), respectively. By the way, FIGS. 13A and 14A respectively illustrates an example where both substrate and integrated heating units are disposed face to face and coaxial with each other. By contrast, FIGS. 13B and 14B respectively illustrates an example where both substrate and integrated heating units are disposed face to face but off-centered from each other. The arrangement of these substrate and heating units is not restricted to the aforementioned examples, but may be relatively positioned in any manner as long as they can take a close-packed structure.

Preferably, the heating lamp should be selected such that the emission peak thereof does not fall in the wavelength where the extinction coefficient (the imaginary term of complex index of refraction) of the optical constant of the treating substrate and of a film formed thereon is not zero and where the absorption band of an light-transporting means is not overlap therewith. It is also preferable that the emission wavelength of the lamp coincides with the peak value of the extinction coefficient of the film.

For example, since the absorption peak of Si substrate comes in the vicinity of 350 nm, it may be desirable, in order to realize an effective heating, to employ as a light source a high-pressure mercury lamp whose inner gas pressure has been adjusted to strengthen the 365 nm oscillating ray thereof. Further, in view of the fact that the absorption band of Si is at most about 1 $\mu$m, a halogen lamp capable of emitting infra-red rays may be employed. In this case, the color temperature of the halogen lamp should desirably be as high as possible.

Meanwhile, there are two procedures for effectively heating an oxide film on a Si substrate as explained below.

(1) Where the Si substrate is to be irradiated from the underside thereof:

Maximum emission wavelength of a lamp is selected such that it falls in a wavelength region which is free from absorption by the Si substrate but can be absorbed by the oxide film. In contrast to quartz which is employed as a light-transporting means, the oxide film includes therein a large quantity of OH group. Although the oscillation absorption band of this OH group exists at 2.8 $\mu$m, if the color temperature of the halogen lamp is selected such that a emission peak would be generated with 1.4 $\mu$m which would generate a double-wave, the oxide film on the surface of Si substrate can be effectively heated without damaging the quartz rod or the Si substrate. For example, when a halogen lamp is employed, the color temperature should preferably be about 2,050K.

(2) Where the Si substrate is to be irradiated from the underside thereof (the Si substrate itself is also heated):

Maximum emission wavelength of a lamp is selected such that it coincides with the absorption band of the Si substrate. Therefore, the color temperature of the halogen lamp should desirably be as high as possible, e.g. preferably 2,800 to 3,500K.

(3) Where the Si substrate is to be irradiated from the upper surface thereof:

In contrast to quartz which is employed as a light-transporting means, the oxide film includes therein a large quantity of OH group. Although the oscillation absorption band of this OH group exists at 2.8 $\mu$m, the color temperature of the halogen lamp should preferably be selected such that a emission peak would be generated with 1.4 $\mu$m which would generate a double-wave. Therefore, the color temperature of the halogen lamp should desirably be as high as possible, e.g. preferably 2,800 to 3,500K.

EXAMPLE 5

In this example, the heating device shown in FIGS. 12A and 12B was utilized for sintering an SOG film deposited on a 8-inch substrate (the base thereof is Si). The treating substrate was positioned as shown in FIG. 13B. A halogen lamp having a color temperature of 2,050K was employed as an infra-red lamp. For the purpose of improving the uniformity of irradiation on the occasion of irradiation of light, the substrate was revolved about the heating unit and at the same time, autorotated. A distance between the light-irradiating faces of the quartz rods and the object is set to around 0.3 L or not less than 0.8 L.

Although the sintering of the substrate took about 30 minutes according to the conventional heating method employing a hot plate, it was possible according to the procedures of this example to finish the sintering of the substrate within about 10 minutes due to an effective excitement of the bonding which contributes to the sintering, thus making it possible to prominently improve the insulation property.

Although an SOG film was heated in this example, this invention is not restricted to this kind of film but is applicable to various kinds of film materials such as insulating films and wiring materials, resist materials, or the sintering of reflection preventive film materials, and also to other kinds of heating step such as the heating step of exposure mask materials.

Furthe r, this heating m et hod is also applicable to the heating of various kinds of light-shielding material such as Cr or MoSi, to various material such as MoSiO, MoSiON, CrF, CrOF, as well as to a conductive film, a resist film or a reflection preventive film which are formed on these materials. In this case, the wavelength of the heating light source may be selected depending on the wavelength dispersion of extinction coefficient of the treating material.

Further, the input value to be applied to the lamp may be suitably controlled so as to make the temperature of surface of the object become uniform. With respect to this controlling, in addition to the conventional PID control, a correcting mechanism for correcting a difference in radiant heat that may be brought about by the changes of color temperature on the occasion of changing input value should preferably be incorporated into the heating device.

It should be noted that this invention is not limited to the aforementioned examples, but may be variously modified within the spirit of the invention. For example, an infra-red lamp has been illustrated in the foregoing examples, a lamp emitting ultraviolet rays can also be employ ed. Although the distance between the light-irradiating faces of the quartz rods and the object was set to 0.3 L in the foregoing examples, this value of 0.3 L is not so critical, and hence, it may be in the vicinity of 0.3 L in the achievement of almost the same effects.

According to the first aspect of this invention, when the distance between the light-irradiating faces of the light transmissive columnar bodies and the object is set to around 0.3 L or not less than 0.8 L (herein, L is a width of the light-irradiating face of the light transmissive columnar body), the influence of a deterioration of optical intensity at the corner portion of the columnar body can be minimized, thus making it possible to sufficiently enhance the uniformity in heating the object.

According to the second aspect of this invention, by performing the control of input to the lamp based on a change of color temperature to be brought about by the input and on a heating characteristic of the object at a color temperature before said input and at a color temperature after said input, it becomes possible to perform an optimum temperature control of the object.

EXAMPLE 6

In the process of manufacturing a semiconductor device, a film having a thickness of 50 nm and a reflection preventive function against an exposure beam was formed on a treating substrate for the purpose of forming gates. Thereafter, an ArF chemically amplified type resist having a thickness of 200 nm was formed on the film. Then, an ArF excimer laser was irradiated to this resist through an exposure mask, thereby forming a latent image of exposure mask pattern. Thereafter, the treating substrate was baked so as to cause a S thermochemical reaction to take place thereon.

Figure 15A:
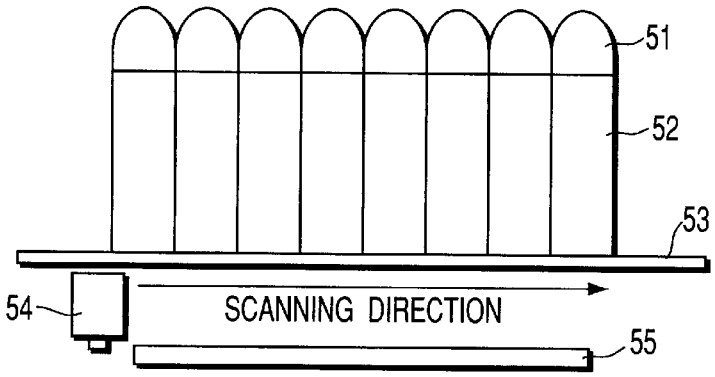
FIGS. 15A to 15E are side views each illustrating the relationship in position between the heating device and the object in Example 6.
Figure 15B:
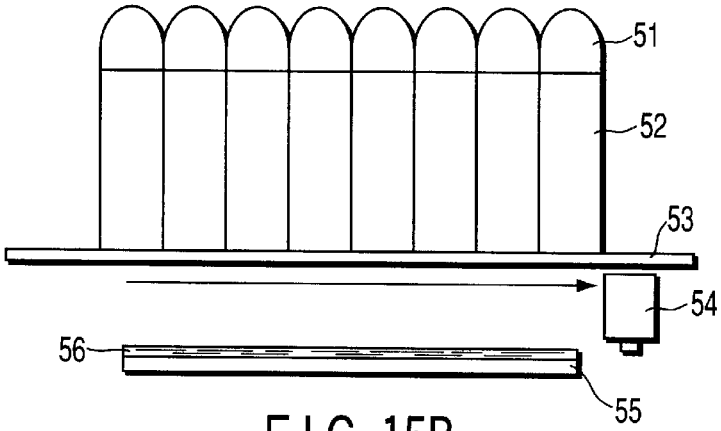

As shown in FIG. 15A, after securing the treating substrate 55 to a holding member (not shown), a chemical liquid-feeding member 54 was moved from one end portion of the treating substrate 55 (temperature thereof: 25° C.) to the other end portion with the chemical liquid-feeding member 54 being kept facing the treating substrate 55, thereby feeding a chemical liquid (such as a developing solution) to the surface of the treating substrate 55. FIG. 15B shows a state where a film of chemical liquid 56 was formed on the surface of the treating substrate 55.

By the way, lamps 51 and quartz rods 52 sustained by a quartz plate 53 were disposed over the treating substrate 55. This quartz plate 53 functions also to protect these lamps 51 and quartz rods 52 from being damaged by the chemical liquid to be discharged from the chemical liquid-feeding member 54.

Since the film of chemical liquid 56 was formed on the surface of the treating substrate 55, a latent heat was allowed to escape through the surface of chemical liquid 56, thus decreasing the temperature of the treating substrate 55. The magnitude of temperature decrease was; 0.3° C. at the central portion of the treating substrate 55, and 0.7° C. at the peripheral portion of the treating substrate 55 where heat is more likely to be escaped.

Figure 15C:
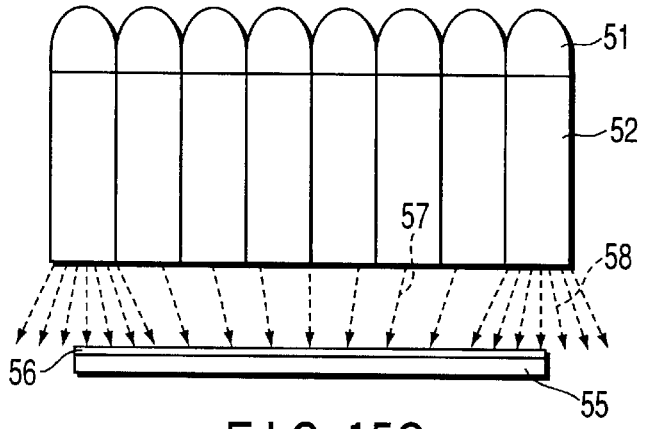

Because of the reason that the dissolving speed of the resist would be deteriorated at this peripheral portion of the treating substrate 55 under this condition, the lamps 51 were turned on as shown in FIG. 15C. During a period immediately after this switch-on of the lamps 51, the output of the lamps disposed to face the peripheral region of the treating substrate 55 was made higher, thereby accelerating the temperature rise of this peripheral region of the treating substrate 55. By the way, the PID control was performed on the lamps 51 so as to increase the temperature of the treating substrate 55 up to 25° C. In FIG. 15C, the reference numeral 57 indicates a low irradiation region where the output of the lamps 51 was relatively low, while 58 indicates a high irradiation region where the output of the lamps 51 was relatively high.

Figure 15D:
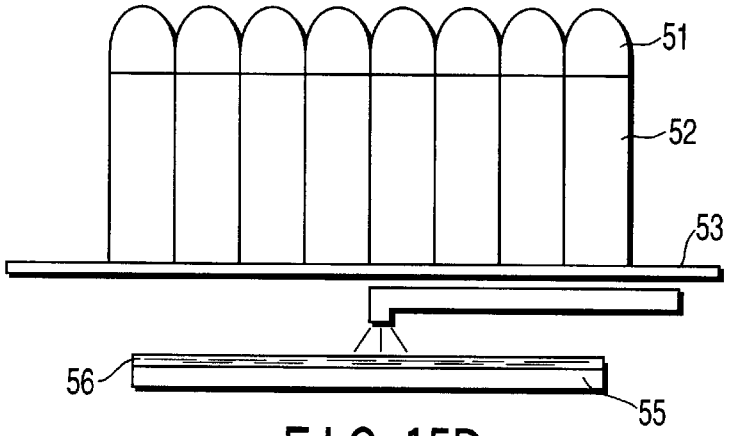

After 60-second heat and chemical liquid's treatments, the lamps 51 was turned off, and then, a stop solution/rinse solution-feeding nozzle 59 was inserted into a space between the quartz rods and the treating substrate 55 as shown in FIG. 15D. Then, while the treating substrate 55 was kept rotated, a stop solution was sprayed at first to the surface of the treating substrate 55 and then, a rinse solution was sprayed to the surface of the treating substrate 55.

Figure 15E:
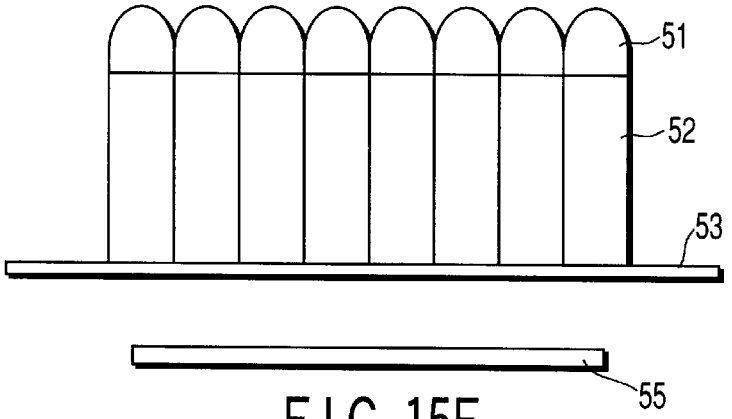

After the spraying of the rinse solution was continued for 20 seconds, the spraying of the rinse solution was stopped, and then, the treating substrate 55 was allowed to rotate at a high speed, thereby removing the rinse solution from the surface of the treating substrate 55 as shown in FIG. 15E.

In this example, the heat lost on the occasion of feeding a chemical liquid to the treating substrate 55 was compensated by irradiating the light of the lamps 51 via the quartz rods 52 onto the treating substrate 55, without causing the developing solution to be heated. As a result, the temperature of the treating substrate 55 was enabled to maintain uniformly, thus making it possible to perform a uniform treatment of the resist with a chemical solution (for example, a developing solution). As a result, it has become possible to prominently improve the reliability of the gate of transistor.

Figure 8B:
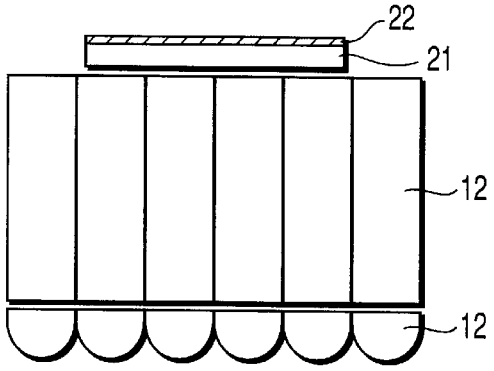

In this example, the lamps were disposed over the treating substrate. However, the lamps may be disposed below the treating substrate as shown in FIG. 8B. However, where a chemical liquid is to be employed as in the case of this example, the lamps 51 and the quartz rods 52 are required to be protected from being damaged by the chemical liquid to be discharged from the chemical liquid-feeding member 54. Therefore, it is preferable to interpose a quartz plate between the treating substrate and the quartz rods so as to prevent the chemical liquid from flowing downward. Since the upper surface of the quartz plate is contacted with the chemical liquid, a suitable washing mechanism should preferably be attached to the apparatus. For example, a pure water may be allowed to flow over the upper surface of the quartz plate during the operation.

In the examples 1 to 6, the quartz rods are constructed such that the light irradiated from the lamps is taken up by one end face of each of the quartz rods, and then, the light is emitted from the other end face thereof. However, any kinds of light transmissive columnar body may be employed other than this quartz rod, provided that it is capable of transmitting the light from the lamps which is sufficient to heat the object to the object. For example, a light transmissive columnar body formed of calcium fluoride ($CaF_2$) or sapphire can be employed.

As for the protecting plate to be interposed between the light transmissive columnar body and the object, the same kinds of material as those of the light transmissive columnar body can be employed. As for the lamp, a halogen lamp, a metal halide lamp, a mercury lamp, tungsten lamp, etc. as well as an excimer lamp formed of KrF, ArF, XeF, $F_2$, etc. can be employed.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A heating method for heating an object by making use of a heating apparatus comprising a plurality of lamps, and a plurality of light transmissive columnar bodies each being positioned in front of said lamps with respect of an light irradiating direction of said lamps and having a fore-end constituting a light incident face for receiving an irradiated light from said lamp and a rear-end constituting a light-irradiating face for irradiating light; said object being disposed to face said light-irradiating faces of the light transmissive columnar bodies and heated by the irradiation of light transmitted via said light transmissive columnar bodies from said lamps;

wherein a distance between said light-irradiating faces of the light transmissive columnar bodies and said object is set to around 0.3 L or not less than 0.8 L in which L is a width of said light-irradiating face of the light transmissive columnar body.

2. The heating method according to claim 1, wherein a distance between the light-irradiating faces of the light transmissive columnar bodies and the object is set to 1 L or more.

3. The heating method according to claim 1, wherein the light to be irradiated from the lamp is at least one selected from the group consisting of visible rays, infrared rays, ultraviolet rays and these laser beam.

4. The heating method according to claim 1, wherein said light transmissive columnar body is formed of a prism or a circular rod.

5. The heating method according to claim 1, wherein said object is selected from the group consisting of a semi-finished substrate during manufacturing process of a semiconductor device, a semi-finished substrate during manufacturing process of a liquid crystal device, and a semi-finished substrate during manufacturing process of an exposure mask.

6. The heating method according to claim 1, wherein said object is disposed in an inner region than an outermost circumference of entire region of the light transmissive columnar bodies by a distance corresponding to the magnitude of divergence L of light.

7. The heating method according to claim 1, wherein said object is placed coaxial with or slightly off-centered from the center of the heating apparatus.

8. The heating method according to claim 1, wherein where the distance between the light-irradiating faces of the light transmissive columnar bodies and the object is set to around 0.3 L, the region for heating the object is confined within a region to be defined by an enclosure line to be formed by successively connecting the centers of the light-irradiating faces of the light transmissive columnar bodies positioned at the outermost circumferential region among a plurality of the light transmissive columnar bodies.

9. The heating method according to claim 1, wherein where the distance between the light-irradiating faces of the light transmissive columnar bodies and the object is set to 0.8 L or more, the region for heating the object is confined within a region to be defined by an enclosure line which is disposed inner than the outermost circumferential edges of the outermost light transmissive columnar bodies by a distance corresponding to the magnitude of divergence L of light among a plurality of the light transmissive columnar bodies.

10. The heating method according to claim 1, wherein the center of the light-emitting face of the lamp is substantially aligned with the center of light-irradiating faces of the light transmissive columnar bodies.

11. The heating method according to claim 1, wherein the center of the light-emitting face of the lamp is off-centered from the center of light-irradiating faces of the light transmissive columnar bodies.

12. The heating method according to claim 1, wherein a light transmissive plate is interposed between the light transmissive columnar bodies and the object.

13. The heating method according to claim 1, wherein the magnitude of light emission of the lamps disposed at a position corresponding to the outer periphery of the object among said plurality of lamps is made larger than that of the lamps other than the first-mentioned lamps.

14. The heating method according to claim 1, which further comprises a step of forming a liquid film on a surface of the object which faces the light-irradiating faces of the light transmissive columnar bodies, and, among said plurality of lamps, the lamps disposed at a place which corresponds to a lower temperature region of the object in a temperature distribution of the object generated by said liquid film or by a reaction of said liquid film with the object are operated to increase the magnitude of light emission so as to offset the temperature distribution of the object.

15. The heating method according to claim 1, wherein said object is a silicon substrate having an oxide film on one of its main surfaces, and the irradiation of light is performed against the other main surface which is opposite to the main surface where said oxide film is formed, wherein the maximum wavelength of light emission of the lamps is selected such that it is not absorbed by silicon but it is absorbed by the oxide film.

16. The heating method according to claim 1, wherein said object is a silicon substrate having an oxide film on one of its main surfaces, and the irradiation of light is performed against the other main surface which is opposite to the main surface where said oxide film is formed, wherein the maximum wavelength of light emission of the lamps falls within the absorption band of silicon.

17. The heating method according to claim 1, wherein said object is a silicon substrate having an oxide film on one of its main surfaces, and the irradiation of light is performed against the main surface where said oxide film is formed, wherein the color temperature of the lamps is selected such that the light emission intensity of the wavelength of vibration absorption band of OH group which enables to generate a double wavelength becomes maximum.

18. A heating method for heating an object by making use of a heating apparatus comprising a plurality of lamps, and a plurality of light transmissive columnar bodies each being positioned in front of and in the light irradiating direction of each of said lamps and having a fore-end constituting a light-receiving face for taking up an irradiated light from said lamp and a rear-end constituting a light-irradiating face for irradiating light; said object being designed to be disposed to face said light-irradiating faces of the light transmissive columnar bodies and designed to be heated by the irradiation of light transmitted via said light transmissive columnar bodies from said lamps;

wherein a control of input to said lamp is performed based on a change of color temperature to be brought about by said input and on a heating characteristic of said object at a color temperature before said input and at a color temperature after said input.

19. The heating method according to claim 1, wherein a distance between said light-irradiating faces of the light transmissive columnar bodies and said object is set to around 0.3 L or not less than 0.8 L (herein, L is a width of said light-irradiating face of the light transmissive columnar body).

20. The heating method according to claim 1, wherein a distance between the light-irradiating faces of the light transmissive columnar bodies and the object is set to 1 L or more.

* * * * *

UNITED STATES PATENT AND TRADEMARK OFFICE

CERTIFICATE OF CORRECTION

PATENT NO. : 6,301,435 B1
DATED : October 9, 2001
INVENTOR(S) : Ito et al.

It is certified that error appears in the above-identified patent and that said Letters Patent is hereby corrected as shown below:

Column 15,
Line 28, change “an light” to -- a light --.
Line 49, change “beam” to -- beams --.

Signed and Sealed this

Eleventh Day of February, 2003

JAMES E. ROGAN
*Director of the United States Patent and Trademark Office*